United States Patent [19]

Freeman

[11] 4,439,033

[45] Mar. 27, 1984

[54] DRUM-CONTAINING APPARATUS FOR READY PROCESSING AND HANDLING OF PHOTOGRAPHIC MATERIAL

[75] Inventor: Barrie A. Freeman, Wickford, England

[73] Assignee: Ciba-Geigy AG, Basel, Switzerland

[21] Appl. No.: 436,906

[22] Filed: Oct. 27, 1982

[30] Foreign Application Priority Data

Nov. 4, 1981 [GB] United Kingdom ..... 8133189

[51] Int. Cl.[3] ..... G03D 3/02; G03D 3/08

[52] U.S. Cl. ..... 354/316; 354/322; 354/325; 354/330

[58] Field of Search ..... 354/308, 309, 312, 316, 354/320, 321, 322, 329, 330, 331, 328, 324, 325; 15/100; 134/122 P, 64 P

[56] References Cited

U.S. PATENT DOCUMENTS

| | | | |
|---|---|---|---|
| 2,940,584 | 6/1960 | Kunz | 354/322 |
| 3,392,653 | 7/1968 | Guinau | 354/320 |
| 3,512,468 | 5/1970 | Haynes | 134/64 P |
| 3,673,985 | 7/1972 | Dols | 354/329 |
| 4,148,576 | 4/1979 | Martino | 354/320 |

FOREIGN PATENT DOCUMENTS

| | | |
|---|---|---|
| 2414824 | 10/1974 | Fed. Rep. of Germany . |
| 2615932 | 10/1977 | Fed. Rep. of Germany . |

*Primary Examiner*—A. A. Mathews

*Attorney, Agent, or Firm*—Harry Falber

[57] ABSTRACT

An apparatus for treating sheets of flexible photographic material with a liquid, comprises a vessel containing a liquid in which is partially immersed a driven drum, means to guide a sheet of flexible photographic material into the liquid so that the emulsion-free side of the sheet adheres to the surface of the drum; rotatable rollers located spacedly about the periphery of the drum help to keep the sheet of photographic material adhered to the surface of the drum. The vessel which contains the liquid is substantially cylindrical and is so shaped that it cooperates with the rollers in keeping the sheet of photographic material adhered to the surface of the drum. An exit part of the sidewall of the vessel above the level of the liquid therein is movable, for instance by being pivotably mounted. When this part is in an open position, a sheet of flexible photographic material emerging frm the liquid can peel away from the drum and enter an exit opening in the vessel and be guided out of the vessel.

12 Claims, 3 Drawing Figures

DRUM-CONTAINING APPARATUS FOR READY PROCESSING AND HANDLING OF PHOTOGRAPHIC MATERIAL

BACKGROUND OF THE INVENTION

This invention relates to apparatus for treating with a liquid sheets of flexible photographic material having a front side and a reverse side the front side being covered with a light sensitive layer, comprising:

a container, a vessel therein which is adapted for receiving the liquid therein up to a determined level, and is of generally cylindrical configuration, having a vessel sidewall;

a drivable drum having a cylindrical surface and being rotatable about a substantially horizontal axis, the said liquid level present in the vessel being sufficiently high to immerse, during rotation of the drum, a lower region thereof in the liquid, guiding means adapted for guiding a sheet of the photographic material into contact with the drum, with the reverse side of the sheet contacting the drum surface; and rotatable roller means spacedly disposed about the drum surface so that wall sections of the vessel are present between every two consecutive roller means, which roller means keep the said sheet, during its passage about the drum and through the liquid in the vessel, in contact with the drum surface.

In the past photohobbyists and professional photographers who have processed their own prints have had to use processing dishes and have had to continuously or intermittently move the prints in the dish to ensure that the print is processed uniformly. Often development processes require four or five minutes or even longer and fixing times can be just as long. Photographic processing houses who handle hundreds of prints per hour have very long processing tanks through which the prints can be fed to develop or fix the print in the requisite time, the action of passing the print through the solution causing fresh solution to come continuously into contact with the print surface. However it is not practical for a photohobbyist or professional photographer who wishes to process only his own prints to have such a processing machine because its large size is dependent on the length of processing time required and on the rate at which prints are to be processed.

In a number of prior art processing machines are described in patent specifications photographic material is fed through a processing machine in which a drum is rotating in the processing liquid and the photographic material is caused to adhere to the outside of the drum for part of a full rotation only, of the drum in the liquid. Examples of such patent specifications are German Offenlegungsschrift No. 1,497,496 and Offenlegungsschrift No. 2,615,932. However, in such proposed machines the material would not be in contact with the processing liquid for sufficient time for the process to be fully carried out, unless rotating very slowly.

Now, in the German Offenlegungsschrift No. 2,414,824 there is described an apparatus in which photographic films are caused to adhere to the surface of a drum which rotates in processing liquid and to rotate with the drum for sufficient length of time for the process to be completed. It is said in Offenlegungsschrift No. 2,414,824 that knives set at an acute angle at a predetermined distance from the surface of the drum have been used to strip-off the photographic film from the surface of the drum but the use of such knives has not been entirely successful. Offenlegungsschrift No. 2,414,824 proposes that a jet of processing liquid issuing from a knife shaped device is used to strip the film from the processing drum. Such a liquid jet is a complicated and expensive device which is satisfactory for a large processing apparatus, but which is inappropriate for a simple processing apparatus suitable for use by a photohobbyist or a professional photographer who wishes to process only his own prints.

OBJECTS AND SUMMARY OF THE INVENTION

It is, therefore, an object of the invention to provide an apparatus of the initially described type which comprises simple means for removing a treated sheet of photographic material from the drum, while permitting several passages of the sheet through the liquid in the vessel.

This object and others which will become apparent from the description of the novel apparatus hereinafter are attained, in accordance with the present invention, by an apparatus of the initially described type in which an entry port in the vessel sidewall, on one side of the vessel above the level of the liquid therein, for introducing the sheet into the vessel, entry closing means adapted for light-tightly closing the said entry port and mounted movably, e.g. for shifting or pivoting so as to permit, when in open position, the introduction of a sheet of the said material into contact with the drum surface preferably under light-tight conditions, an exit opening in the vessel sidewall located above the level of the liquid in the vessel and on the side of the vessel opposite the said entry port, and exit-controlling means comprising a part of the vessel sidewall which is movable, and preferably shiftable or pivotable as a door, between a closed position closing the exit opening, and an open position, and being so shaped as to permit, when in the said closed position, the leading edge of a sheet to slide unobstructedly along the part and on to the vessel sidewall or roller means above said exit opening, while, when the movable sidewall part is in open position, a sheet emerging from the liquid can peel away from the drum surface sufficiently to enter the exit opening, and the exit-controlling means further comprise deflecting wall means extending outwardly from the upper end of the exit opening, and adapted for guiding a peeled-away sheet entering with its leading edge the exit opening, out of the container.

When the movable sidewall or door is closed it shuts off light-tight the exit opening in the vessel sidewall. Preferably the entry port is also above the liquid level in the vessel.

The wall sections of the vessel between two consecutive rollers are preferably so shaped that sheets whose leading edge lifts from the drum in consequence of the inherent rigidity of the sheets, are again guided by the rollers to be inserted between the drum and the next consecutive roller. Each of the wall sections of the vessel between two consecutive rollers preferably converges continuously inwards in the direction of rotation of the drum, and most preferably such wall sections are of curved configuration. The movable sidewall part which renders light-tight the exit opening has preferably substantially the same shape as the aforesaid wall sections between two consecutive rollers.

Preferably, the exit opening is also kept in light-tight condition while the movable sidewall part is in open position, as long as the sheet exiting from the vessel could still be affected adversely by light from the outside.

In a preferred embodiment of the apparatus according to the invention the exit opening extends axially between a lower and an upper axially extending rim portion of the vessel sidewall, the movable sidewall part is hingedly mounted on the sidewall lower rim portion, and the deflecting wall means are joined to the sidewall upper rim portion and extend sufficiently close to the drum surface so that a sheet emerging from the liquid and bending away from the drum surface can abut with its leading sheet edge against the deflecting wall means to be guided out of the container.

In closed position, the closing edge of the movable part should so overlap the inward end of the deflecting wall.

The deflecting wall means are preferably of curved cross section, in a plane transverse to the drum axis, the concave side of the curved cross section being turned toward the lower sidewall rim portion adjacent the exit opening.

The treatment to which the photographic material sheet is subjected in the apparatus may be a processing step, for example a development step or fixing step, in which case the liquid in the apparatus is a photographic processing liquid. Alternatively, the treatment may be a washing step in which case the liquid in the apparatus is water.

In one preferred embodiment of the invention one of the rotatable rollers which help to keep the sheet of photographic material adhered to the surface of the drum is replaced by a brush which serves to agitate the liquid over the surface of the photographic sheet material. This modification is particularly preferred when the apparatus is a washing apparatus.

Preferably, in this embodiment of the invention there is also provided means to spray a jet of water on to the sheet of photographic material from the drum. In this embodiment a water overflow is also provided to keep the level of water in the vessel constant, at least whilst the spray is in operation.

Preferably, the driven drum is polyvinyl chloride covered, while the rotatable rollers are preferably composed of rubber or a suitable synthetic platics material, for example polyvinyl chloride.

Thus, in operation the sheet of photographic material is guided into the vessel, which contains the processing solution or wash water, into the liquid, emulsion surface downwards, so that its emulsion-free side is caused to adhere to the rotating drum. The drum is then caused to rotate for sufficient length of time for the processing step which is performed or the washing in the apparatus to be completed. The number of revolutions of the drum required to occupy this time can be preset on a revolution counter and the drum then continues to rotate in the vessel with the sheet of photographic material adhered to its surface.

When the liquid is a photographic processing solution the sheet of photographic material at each revolution will pick-up a fresh amount of solution and the spent solution will be washed from the emulsion surface as the sheet material reenters the solution in the processing apparatus.

When the liquid is wash water the sheet of photographic material at each revolution will pick-up an amount of wash water and will also be subjected to a spray of fresh water as it is carried round on the surface of the drum.

When the preset number of revolutions on the revolution counter attached to the drum have been accomplished the revolution counter causes a solenoid-operated mechanism to open the movable sidewall part of the vessel and the sheet will peel from the surface of the drum and be guided out of the vessel.

In another embodiment a handle located outside the processing vessel is attached to the movable sidewall part or door in the sidewall of the vessel and when this handle is pulled the movable sidewall part or door in the vessel sidewall is opened and permits the sheet to be ejected after a preset time has past.

A photographic processing system may comprise several such processing apparatus joined as interlocking modules. For example a first apparatus according to the invention may contain photographic developer and a print may require 5 minutes processing therein, a second apparatus according to the invention may contain an acid stop bath and require 2 minutes processing, a third apparatus may contain a fixing solution and require 8 minutes processing and a fourth may be a washing apparatus and require 10 minutes to complete the wash. In another such system, the apparatus containing the acid stop bath may not be needed and can be omitted.

When the apparatus of the present invention is used for treating sheets of flexible photographic material the sheet is held adhered to the surface of the drum partly by moisture attraction, partly by the array of rollers around the periphery of the drum and partly by the configuration of the sidewall of the cylindrical vessel. The natural tendency of the flexible sheet is to peel off and bend away from the surface of the drum. Thus the openable, movable sidewall part of the vessel is located between two of the rollers. When this sidewall part is closed its surface is so shaped that it urges the sheet to remain adhering to the surface of the drum but when this sidewall part is opened the leading edge of the sheet starts to peel away from the drum when it has passed the roller preceding the exit opening, so that, instead of the sheet being pressed down again on to the drum by the configuration of the movable sidewall part, it is guided out of the vessel.

The movable sidewall part can have a curvature such that the concave surface of this part faces toward the drum surface when the sidewall part is in closed position.

The deflecting wall means preferably serve as a roof of a discharge channel into which the exit opening leads when the movable sidewall part is in open position. To facilitate smooth guidance of a stiff sheet into the exit channel, this roof is preferably of curved cross section with its concave face turned toward the exit opening and/or the exit channel. Preferably, the deflecting wall is manufactured integrally with an upper portion of the vessel which portion is preferably also integral with an upper half of the outer container wall.

The height of the exit opening between the lower and upper rim portions of the vessel sidewall must be of sufficient length, and the roller last-preceding the exit opening must be sufficiently spaced from the sidewall lower rim, to permit sufficient peeling of the sheet away from the drum surface to enter the discharge channel.

BRIEF DESCRIPTION OF THE DRAWINGS

Further objects, details and advantages of the processing apparatus according to the invention will become apparent from the following description of preferred embodiments thereof with reference to the accompanying drawings in which.

In all of the figures like numerals indicate like parts.

DETAILED DESCRIPTION OF THE EMBODIMENTS SHOWN IN THE DRAWINGS

Figure 1:
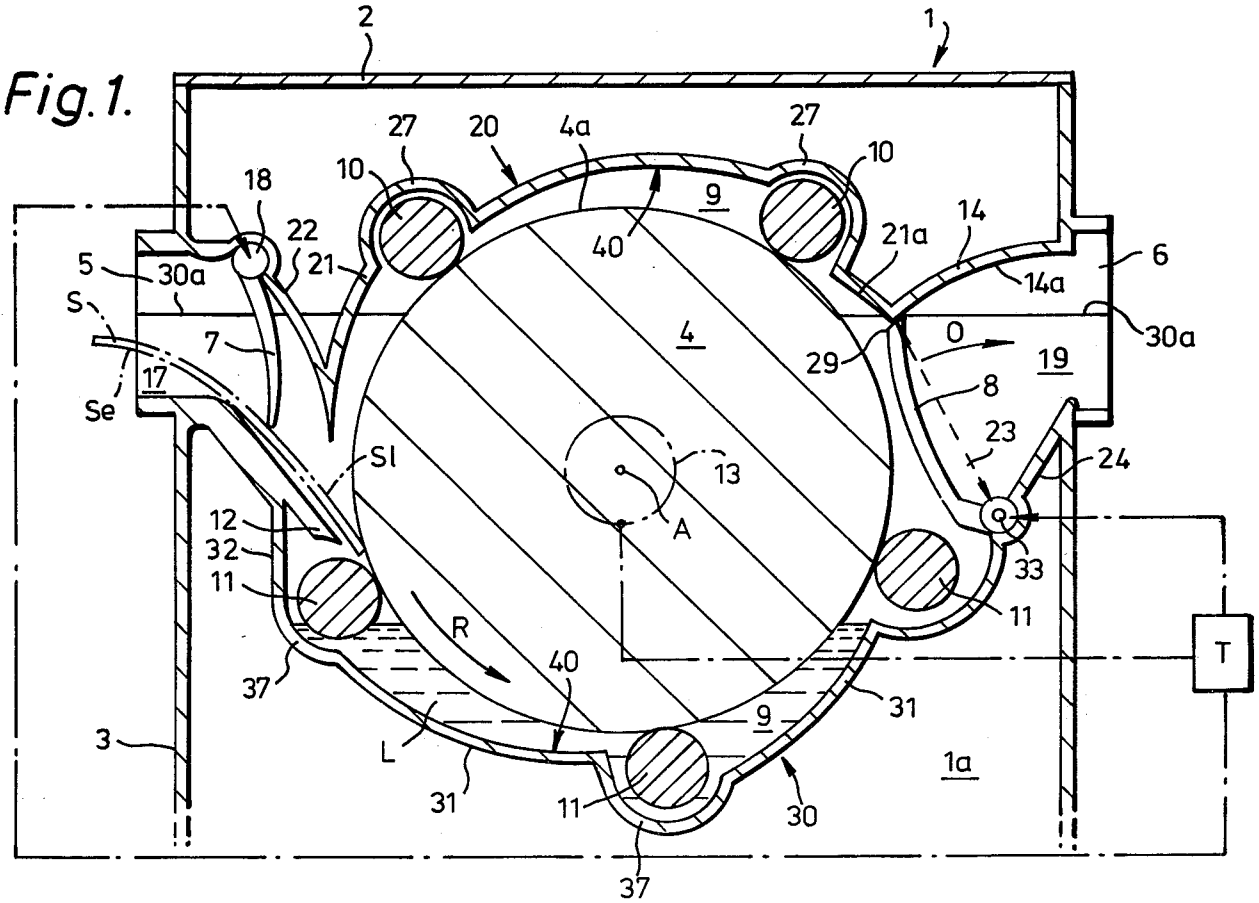
FIG. 1 is a schematical cross-sectional view of a preferred embodiment of the processing apparatus according to the invention.

The preferred embodiment of a processing apparatus as shown in FIG. 1 comprises a light-tight container 1 consisting of an upper half 2 and a lower half 3.

There are provided in the interior 1*a* of the container, two vessel halves 20 and 30, of which the former, upper vessel half 20 is preferably manufactured integrally with the upper container half 2, while the latter, lower vessel half 30 is preferably manufactured integral with the lower container half 3.

Fastening means of a conventional type are used to hold the two container halves 2 and 3 and the vessel halves 20 and 30 therein together in properly adjusted liquid-tight position, thus producing the container and the composite vessel 40 therein, but have been omitted from the drawings for the sake of clarity.

In the hollow interior 9 of the vessel 40 which is elongated and has a central longitudinal axis A, there is housed a cylindrical drum 4 having a polyvinyl chloride-covered drum surface 4*a* and being mounted by means of a shaft or hubs 13 (of which only one is indicated by dashed lines in FIG. 1) in the front and read walls (not shown) of the lower container half 3, coaxially with the longitudinal axis A and rotatable about the latter. The usual drive means drivingly engaging the drum shaft or hub 13 have not been shown in the drawings.

The bottom zone of the lower vessel half 30 contains a processing solution, forming a liquid bath L which fills this zone up to a sufficiently high level so that a lowermost portion of the drum 4 is immersed in the liquid bath, whereby the drum surface and any sheet material adhering thereto pass through the bath L as the drum rotates. In the case of the embodiments shown in FIGS. 1 and 2 the rotation of the drum will be in the sense indicated by the arrow R.

Arranged evenly spaced about the periphery of the drum 4 there are provided five idler rollers 10 and 11 which can be supported in conventional bearings (not shown) in the front wall and the rear wall (not shown) of the lower and upper container halves 2 and 3, respectively.

Gaps (not shown) permitting the passage of a sheet S between the drum surface 4*a* and the rollers can be provided, and/or conventional biassing means (not shown) can be installed at the front and rear walls of the upper and lower container halves which means bias the rollers 10 and 11 toward the drum surface 4*a* with a pressure small enough for the rollers to yield and permit easy passage of a sheet S on the drum 4 without damaging the emulsion layer SE on the sheet S.

In the sidewalls of the upper and lower vessel halves 20 and 30, there are provided outwardly bulging sidewall portions 27 and 37, respectively, which extend parallel with the longitudinal axis A and contain grooves in each of which there is lodged one of the rollers 10,11. Between every two consecutive rollers 10,11 and the respective bulging sidewall portions 27 and/or 37, there extend intermediate wall sections 21 and 31 which can be of curved cross-section, in which case each intermediate wall section 21 or 31 converges continuously inward in the direction of rotation of the drum 4 (arrow R) toward the drum surface 4*a*.

For instance, when the drum 4 has a diameter of 100 mm the distance between the wall section 21 or 31 and the drum surface 4*a*, at the "upstream" beginning of the section can be 15 to 20 mm, while at the "downstream" end of the section (taken in the direction of drum rotation) that distance can be 3 to 6 mm.

On the left hand side in FIG. 1, an entry port 5 is provided in the sidewall of the container 1, above the liquid level in the vessel 40, and a sheet entry passage 17 enclosed by walls 22 and 32, integral respectively, with the upper and the lower container halves 2 and 3 and vessel halves 20 and 30, leads into the vessel 40, opening out of the sidewall of the lower vessel half 30 into the vessel interior 9.

At the inner end of the entry passage 17 there is provided a guide shelf 12 as an inward extension of the passage wall 32 of the vessel half 30.

A flap 7 which is pivotably mounted on hinge means 18 in the upper entry passage wall 22, can be slightly biassed by spring means (not shown) into closing the entry port 5 in a light-tight manner, (FIG. 1). If properly positioned, its own weight can be sufficient to impart the necessary closing bias to the flap 7.

In the sidewall of the container 1, opposite the entry port 5 and above the level of liquid L, a discharge port 6 is provided through which a sheet discharge duct 19 opens to the outside. The inner end of the discharge duct 19 forms an exit opening 23 in the sidewall of the lower vessel half 30 between the nearest consecutive bulging sidewall portion 37 in the lower vessel half 30 and the top edge 30*a* of the latter which is joined to the upper vessel half 20. The discharge duct 19 is delimited at the top by a sheet-deflecting roof wall 14 being integral with that portion of the sidewall of the upper vessel half 20 which is next adjacent the upper end of the exit opening 23 through which the discharge duct 19 can be in free communication with the vessel interior 9, when in open condition.

The innermost end of the deflecting roof wall 14 is thus joined to or integral with a portion 21*a* of the vessel sidewall ahead of or directly at the next-following bulging wall portion 27 (in the direction of drum rotation) of the upper vessel half 20. In the lower vessel half 30, the discharge duct 19 is delimited by a duct bottom wall 24.

A pivotable sidewall part or door 8 which is mounted on hinge means 33 in the sidewall of the lower vessel half 30 at the lower end of the exit opening 23, where the sidewall of this vessel half 30 merges with the duct bottom wall 24, serves for closing light-tight the exit opening 23 and is biassed into the closing position (shown in FIG. 1) by conventional spring means (not shown). The arrow O indicates the direction in which the sidewall part 8 opens. The sheet-deflecting roof wall 14 is preferably of curved cross section as shown in FIGS. 1 and 2, with it concave side 14*a* turned toward the discharge duct 19.

Figure 2:
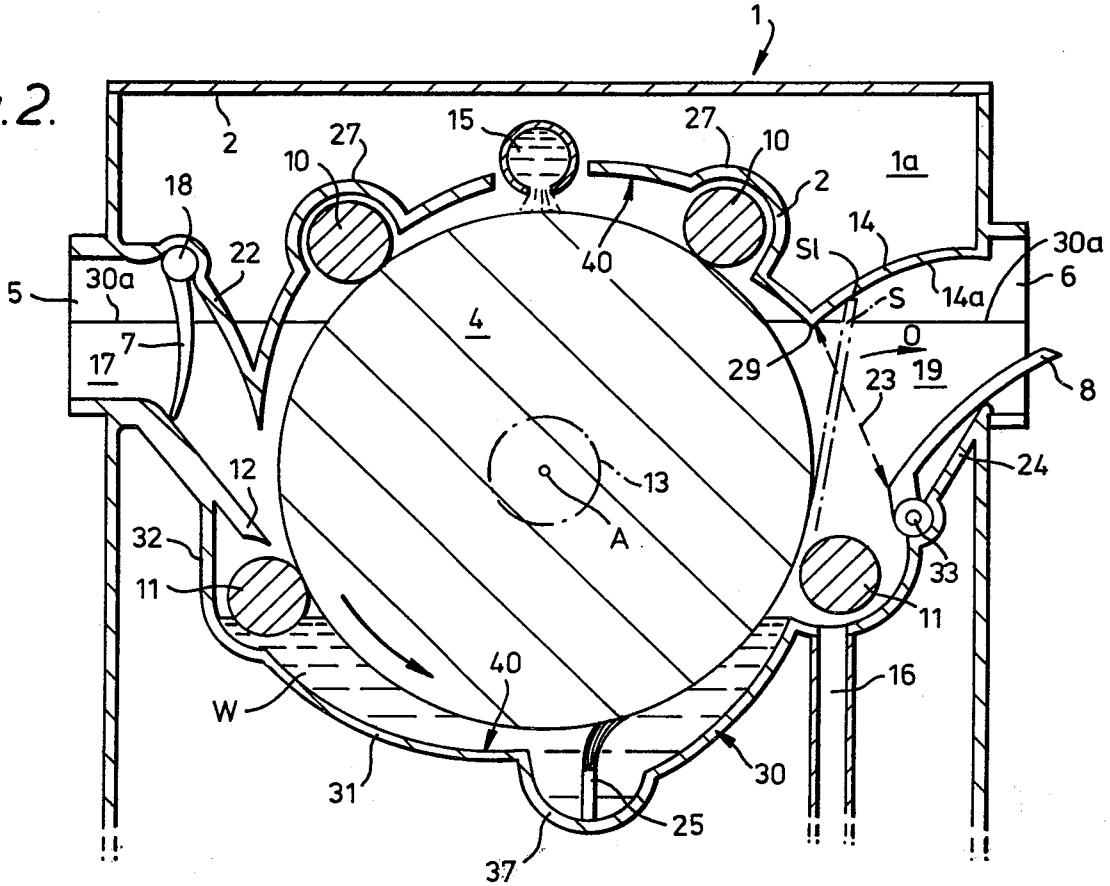
FIG. 2 is a schematical cross-sectional view of an embodiment adapted for use as a washing apparatus according to the invention.

As the sheet entry means and exit means are identical in the two embodiments shown in FIGS. 1 and 2, the exit means have been shown in open position in FIG. 2 and reference will therefore, be had also to the latter figure in explaining the operation of the embodiment shown in FIG. 1.

When starting the operation of the apparatus embodiment shown in FIG. 1, the pivotable sidewall part 8 is closed, processing liquid L has been introduced into the interior 9 in the lower vessel half 30, the drum 4 is caused to rotate about its shaft 13, and a sheet of photographic material S is fed into the entry passage 17 with its face SE bearing an emulsion layer being turned downward. The action of the sheet S raises the flap 7 slightly to pass thereunder, and, guided by the guide shelf 12, into contact with the drum surface 4*a*. The rotation of the drum 4 draws the sheet along to be gripped between the drum surface 4*a* and the first, left-hand roller 11 in the lower vessel half 30. As soon as the sheet S has been drawn past the flap 7 the latter shuts again closing the entry passage 17 in a light-tight manner.

The sheet S is caused to adhere to the drum surface 4*a* by the joint effects of moisture attraction, pressure of the rollers 11 against the sheet face and additionally the converging shape of the intermediate wall sections 31 of the sidewall of the lower vessel half 30.

The sheet of photographic material is driven round on the outside of the drum 4 through the liquid L a sufficient number of times for the bath treatment to be effective. When sufficient time has elapsed as shown on a timer T, the movable sidewall part 8 is opened (FIG. 2), and, due to the natural curling tendency of the sheet material about the face SE thereof bearing the emulsion layer, the leading edge SL of the sheet S is bent away from the drum surface 4*a* and enters the sheet discharge duct 19. The edge or rim 29 formed along the merging zone between the roof wall 14 and the adjacent intermediate wall section 21*a* next adjacent the exit opening 23 should be located sufficiently close to the drum surface 4*a* to prevent an insufficiently deflected sheet S from contacting the wall section 21*a* and from being returned to the work cycle. In practice, when the drum 4 has a diameter of 100 mm, the closest distance of the drum surface 4*a* from the closed pivotable sidewall part (or door) 8 is about 2 to 5 mm, the innermost edge at 29 of the roof wall 14 should be slightly farther away, e.g. 6 to 10 mm, from the drum surface 4*a* than the free edge of the door 8 when the latter is in closed position; in other words the free door edge should cover the roof wall edge 29, so that the latter forms no step in the sidewall at which the leading edge SL of a sheet S could be caught.

Depending on the degree of deflection of the sheet S from the drum surface 4*a*, which in turn also depends on the inherent stiffness of the sheet S, the leading edge SL of the sheet S may then contact the concave face 14*a* of the roof wall 14 and slide along the same toward the outside. Less stiff sheets may curl more strongly and pass into and through the discharge duct 19 without touching the roof wall 14. The sheet material may then be fed to a similar processing apparatus which contains a different processing liquid or to the washing apparatus shown in FIG. 2.

Processing liquid L may be filled into the lower vessel half 30 or emptied from the same by removing the upper container and vessel half 2,20 from the lower half 3,30, thereby opening the vessel interior 9.

In a series of treatments, rinsing the processed sheets in water is usually the final step.

While the parts of the embodiment of an apparatus shown in FIG. 2 are identical with those of the embodiment of FIG. 1 in most respects, the embodiment of FIG. 2 is particularly suited for use in the rinsing step. To this end, the lower vessel half 30 is charged with water W up to a level which is maintained constant by means of an overflow tube 16 which can be fixed as shown or adjustably lodged in the sidewall of the lower vessel half 30. Moreover fresh water is introduced as desired through a spray tube 15 which is disposed above the drum 4 between the two rollers 10 in the upper container half 2 and sprays water onto the top region of the drum 4 through an opening or a plurality of openings in the sidewall section 21 intermediate the two rollers 10.

In addition, the rinsing treatment can be intensified by replacing the central one of the rollers 11 which are in contact with the lower region of the drum 4, by a brush 25 which also urges a sheet S against the drum surface 4*a* and at the same time brushes off residual processing solution and applies water to the processed face SE of the sheet S.

When the washing step is completed, as shown on timer T, the movable sidewall part 8 is opened as shown in FIG. 2 and the sheet S will leave the washing station in the same manner as described hereinbefore in connection with the preceding embodiment.

Figure 3:
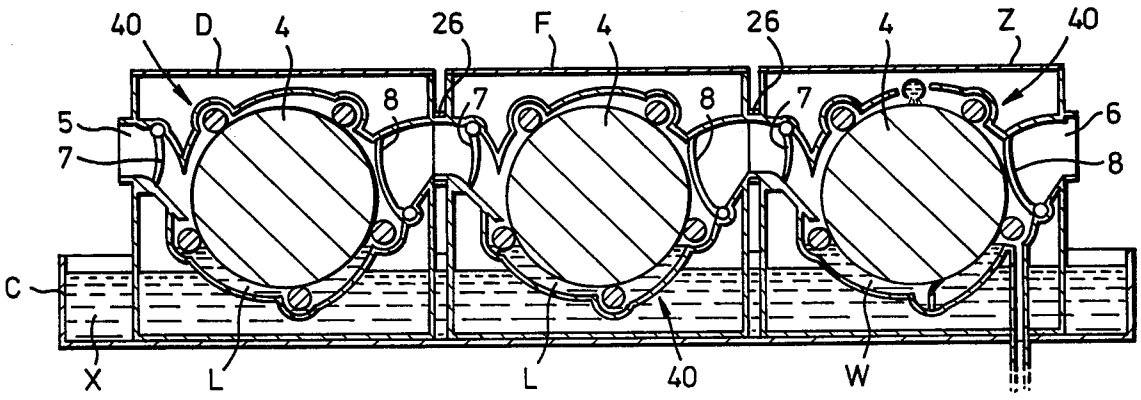
FIG. 3 is a schematical cross-sectional view of a processing system which incorporates two of the apparatus shown in FIG. 1 and one apparatus as shown in FIG. 2.

In FIG. 3 a photographic processing system comprises a developing apparatus D which is an embodiment of the type shown in FIG. 1, a fixing solution apparatus F which is also an embodiment of the type shown in FIG. 1 and a washing apparatus Z which is an embodiment of the type shown in FIG. 2. All three apparatus are linked with each other in series in a light-tight manner by means of overlapping flanges 26.

In this embodiment an automatic timer of a conventional type is preferably connected to each of the apparatus D, F and Z. An electronic detection means of a known type is attached to each entry port-closing flap 7 and as soon as the leading edge of a sheet of photographic material raises only one of the flaps 7, the count down starts. When the preset time is reached for each timer the movable sidewall part 8 is caused to open by means of a solenoid operated moving means attached to each sidewall part 8 and which is activated by the timer connected to the respective apparatus. The sheet then leaves that apparatus and enters the next following apparatus or if this is the last stage apparatus filled with water W the sheet will leave the system. The sheet can then be fed to a drier.

All three apparatus can be placed with foot portions of their containers 1 in an elongated tub C which is filled with warm water X. The latter can penetrate through suitable openings (not shown) in the sidewalls of the lower container halves 3 into the latter and fill them to a level reaching the undersides of the lower vessel halves 30, thus heating the liquids contained in the latter to a desired common temperature.

What is claimed is:

1. Apparatus for treating with a liquid sheets of flexible photographic material having a front side and a reverse side, the front side being covered with a light sensitive emulsion layer, comprising:

a container, a vessel therein which is adapted for receiving the liquid therein up to a determined level, and is of generally cylindrical configuration, having a vessel sidewall;

a drivable drum having a cylindrical surface and being rotatable about a substantially horizontal axis, the said liquid level present in said vessel being sufficiently high to immerse, during rotation of said drum, a lower region thereof in the liquid, guiding means adapted for guiding a sheet of said photographic material into contact with said drum, with the reverse side of the sheet contacting said drum surface;

rotatable roller means spacedly disposed about said drum surface so that wall sections of the vessel are present between every two consecutive roller means, which roller means keep said sheet, during its passage about said drum and through the liquid in the vessel, in contact with said drum surface;

an entry port in said vessel sidewall, for introducing said sheet into said vessel, entry closing means adapted for light-tightly closing said entry port and mounted movably so as to permit, when in open position, the introduction of a sheet of said material into contact with said drum surface, an exit opening in said vessel sidewall located above the level of the liquid in said vessel and on the side of said vessel opposite said entry port, and exit-controlling means comprising a part of the vessel sidewall which is movable between a closed position closing said exit opening, and an open position, said movable sidewall part being so shaped as to permit, when in the said closed position, the leading edge of a sheet to slide unobstructedly along the part and on to the vessel sidewall or roller means above said exit opening, and said movable sidewall part being so shaped as to permit, when the movable sidewall part is in open position, a sheet emerging from the liquid to peel away from the drum surface sufficiently to enter the exit opening, said exit-controlling means further comprising deflecting wall means extending outward from the upper end of said exit opening, and adapted for guiding a peeled-away sheet entering with its leading edge said exit opening, out of the container.

2. The apparatus of claim 1, wherein said sidewall has a lower and an upper axially extending rim portion of said vessel sidewall, said movable sidewall part being hingedly mounted on said sidewall lower rim portion, said exit opening extending from said lower to said upper rim portion, and wherein said deflecting wall means are joined to said upper rim portion in an axially extending zone which zone is sufficiently close to said drum surface so that a sheet emerging from said liquid and bending away from said drum surface can abut with its leading sheet edge against said deflecting wall means to be guided out of said container.

3. The apparatus of claim 2, wherein said deflecting wall means are of curved cross section, in a plane transverse to said drum axis, the concave side of said curved cross section being turned toward said lower sidewall rim portion adjacent said exit opening.

4. The apparatus of claim 1, wherein said movable sidewall part adapted for closing light-tight said exit opening, has a face, turned toward said drum surface, which is of substantially the same shape as the faces of wall sections between two consecutive roller means.

5. The apparatus of claim 4, wherein said movable sidewall part has a free edge which, when said part is in closed position, contacts said zone in which said sidewall upper rim portion and said deflecting wall means are joined, and wherein said free edge of said movable sidewall part, when in closed position, protrudes inwardly of said zone, whereby the distance between said drum surface and said free edge of said closed part is shorter than the distance between said drum surface and said zone.

6. The apparatus of claim 1, wherein the wall sections of said vessel between two consecutive roller means are so shaped that sheets whose leading edge lifts from the drum in consequence of the inherent rigidity of said sheets, are again guided by said roller means to be inserted between the drum and the next consecutive roller means.

7. The apparatus of claim 1, wherein each of the wall sections of said vessel between two consecutive roller means converge continuously inwards in the direction of rotation of said drum.

8. The apparatus of claim 7, wherein the cross section of said converging wall sections in a plane transverse to said drum axis is curved, the concave side of said curvature being turned toward said drum surface.

9. The apparatus of claim 1 further comprising a brush positioned adjacent said drum surface which serves to agitate the liquid over the surface of the photographic sheet material and to keep the sheet of photographic material adhered to said drum surface.

10. The apparatus of claim 9 further comprising means to spray a jet of water on to the sheet of photographic material on the drum, and a water overflow pipe adapted for keeping the level of the water in said vessel constant.

11. The apparatus of claim 1, further comprising means adapted for opening said movable sidewall part when a preset number of revolutions of said drum have taken place.

12. A photographic processing system comprising, arranged in series, a first apparatus as defined in claim 1 and adapted for serving as a developing station, a second apparatus as defined in claim 1 and adapted for serving as a fixing station, and a third apparatus as defined in claim 10 adapted for serving as a washing station, all of these apparatus being joined together as an interlocking module.

* * * * *